US006026932A

United States Patent [19]

Comp

[11] Patent Number: 6,026,932

[45] Date of Patent: Feb. 22, 2000

[54] FLUSH MOUNTING SCAFFOLDING BRACE

[76] Inventor: Bradley L. Comp, 560 Grubbsmill Rd., West Chester, Pa. 19380

[21] Appl. No.: 08/969,493

[22] Filed: Nov. 13, 1997

[51] Int. Cl.[7] ..... E04G 3/10

[52] U.S. Cl. ..... 182/150; 182/82; 182/87; 248/240; 248/240.4

[58] Field of Search ..... 182/82, 87, 150, 182/45; 248/235, 240, 240.4, 247, 237

[56] References Cited

U.S. PATENT DOCUMENTS

| | | | |
|---|---|---|---|
| 168,355 | 10/1875 | Talbott, Jr. | 182/45 |
| 380,395 | 4/1888 | Kramer | 182/45 X |
| 474,406 | 5/1892 | Ramsey . | |
| 528,169 | 10/1894 | Kenison et al. | 182/45 X |
| 596,430 | 12/1897 | Wilson . | |
| 612,256 | 10/1898 | Mattson | 182/45 |
| 681,649 | 8/1901 | Chase | 182/45 |
| 718,602 | 1/1903 | Chase | 182/45 X |
| 945,162 | 1/1910 | Hause . | |
| 955,159 | 4/1910 | Hillmon | 182/45 |
| 2,121,704 | 6/1938 | Leeworthy | 248/235 |
| 2,226,359 | 12/1940 | Spencer | 248/235 |
| 2,840,424 | 6/1958 | Broderick | 182/45 X |
| 2,855,654 | 10/1958 | Stroben | 248/235 X |
| 3,119,590 | 1/1964 | Eriksson | 182/82 X |
| 3,669,395 | 6/1972 | Gehrke | 248/235 |
| 3,695,569 | 10/1972 | Pullan | 248/235 |
| 3,698,680 | 10/1972 | Shoemaker | 249/189 |
| 3,804,199 | 4/1974 | Bondi | 182/82 |
| 4,401,184 | 8/1983 | Sherry | 182/45 |
| 4,452,336 | 6/1984 | Sickler | 182/82 |
| 4,673,060 | 6/1987 | Gregory | 182/82 |
| 4,869,451 | 9/1989 | Gordon | 248/235 |
| 4,884,775 | 12/1989 | Fischer, Jr. | 182/45 X |
| 4,971,169 | 11/1990 | Fruth | 182/150 X |
| 5,067,586 | 11/1991 | Myers | 182/82 X |
| 5,259,477 | 11/1993 | Fears et al. | 182/82 |
| 5,318,148 | 6/1994 | Franco et al. | 182/45 |
| 5,503,358 | 4/1996 | Lapp | 248/235 |
| 5,535,974 | 7/1996 | Savitski | 248/246 |
| 5,647,451 | 7/1997 | Reichel | 182/45 |

*Primary Examiner*—Daniel P. Stodola
*Assistant Examiner*—Richard M. Smith
*Attorney, Agent, or Firm*—Howson and Howson

[57] ABSTRACT

A portable, collapsible brace for mounting scaffolding on the side of a building, comprises a generally "U"-shaped structure made up of two bent arms, each comprising an upright, surface-engaging section having an oblique section at its lower end. The upright sections are spaced from each other by a standard building wall stud spacing and can be nailed to the studs. The oblique sections are connected to each other at a point between the stud locations. An arm is pivotally connected to this point, and is removably engageable with a platform pivoted to the upright sections. The platform is also generally U-shaped, and nests inside the attachment arm structure in coplanar relationship therewith when the apparatus is collapsed.

12 Claims, 7 Drawing Sheets

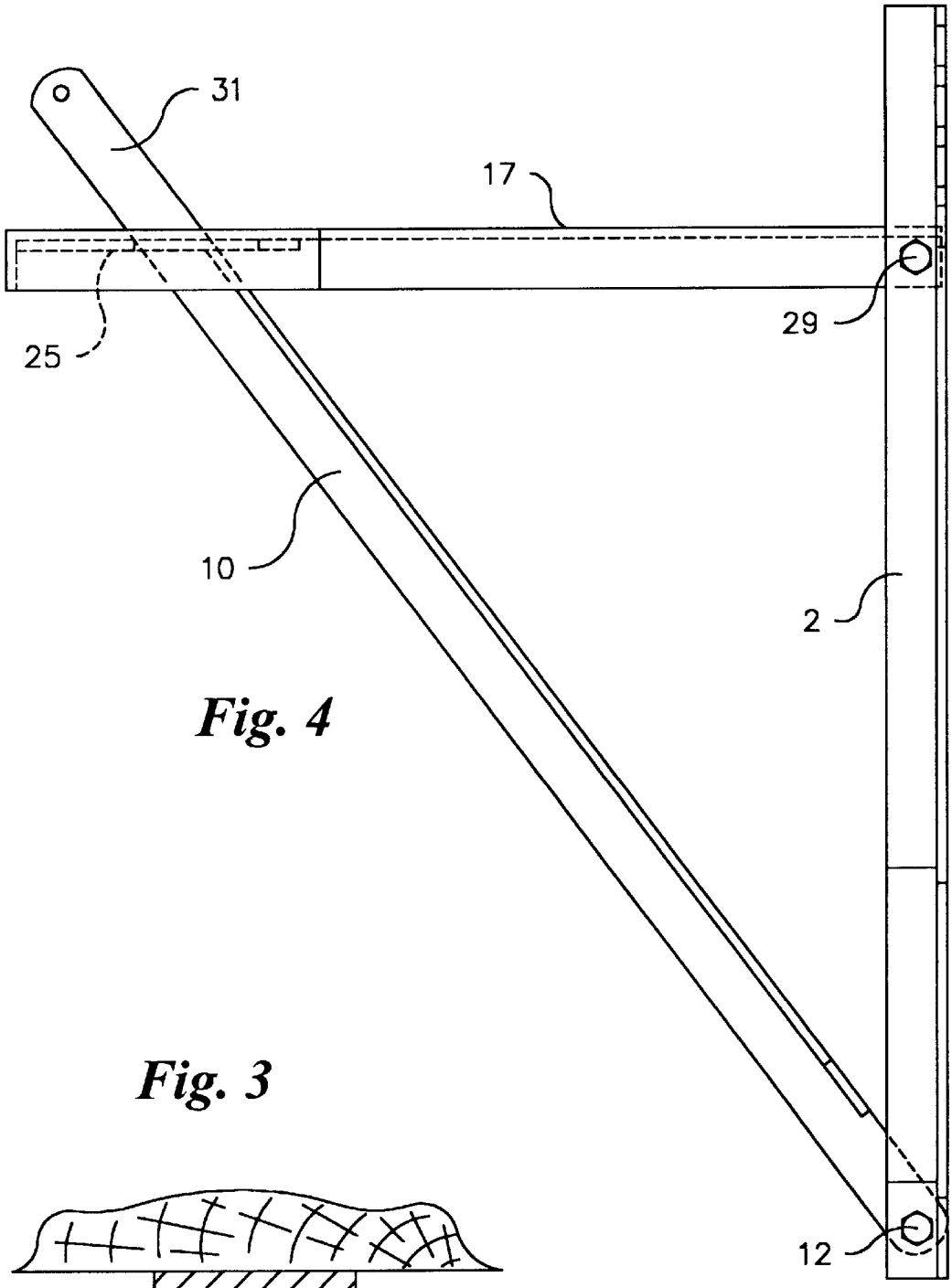
*Fig. 4*
*Fig. 3*
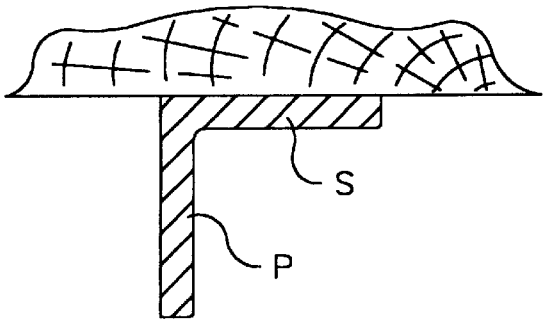

FLUSH MOUNTING SCAFFOLDING BRACE

BACKGROUND OF THE INVENTION

1. Field of the Invention

This invention relates to the construction industry, and more specifically to a scaffolding brace that is attached to and supported by the upright studs used in both commercial and residential construction. The scaffolding brace of this invention is designed to be quickly secured to two adjacent parallel wall studs which may or may not have been previously covered with a facing/sheathing material and insulation. The scaffolding brace may be used individually to provide a small platform upon which an individual may work, or multiple scaffolding braces can be used to provide support for planking suspended between pairs of the scaffolding braces.

2. Description of Prior Art

Typically, during frame building construction, after the basic frame is erected and exterior sheathing has been applied, carpenters and roofers need to work high up on the exterior of the building to begin roof installation or to finish work on the cornice. Presently in residential construction, three methods are used to provide scaffolding upon which workmen may stand when working on the exterior of a building. The method most frequently used by far is to build wooden scaffolding which is directly attached to the structure. To build these scaffolds, at the corners of the building horizontal supports which extend beyond the face of the building are first nailed through the exterior sheathing into the studs. Supporting braces attached to the end of the horizontal supports and the side of the building are placed at approximately 45 degrees to form triangular supports. The provision of horizontal supports along a face of the building is more difficult. Holes, sufficiently large to pass horizontal supports are first cut through the exterior sheathing. The horizontal supports, which are typically two by fours, are then passed through these holes and nailed to studs within the building. Frequently, no interior studs are positioned in the correct location and additional framing is required within the building to firmly anchor the horizontal supports. To complete the scaffolding, long planks are then laid between the extended horizontal supports. For each face of the building where scaffolding is required, this process is repeated. There are several problems with this method of scaffold construction. First, limited load bearing and very little lateral stability is provided by the extended horizontal supports and the erected scaffolding can be dangerously unstable. Frequently the horizontal supports break under the cantilever loads where knots weaken the wood. Further, not only does this method leave holes in the exterior sheathing which then need to be repaired, but the presence of the horizontal members and associated framing within the building makes interior work more difficult. Additionally, the effort required to assemble and disassemble the scaffolding adds significant extra time which skilled carpenters need to spend on the job. Finally, lumber costs and use increase with the extent of the scaffolding required.

Two alternative methods are currently employed to cut down on the time, labor, and material required to build attached wooden scaffolding. The first of these alternative methods makes use of the ladders always present at a construction site. Two or more ladders (depending on the length of the building) are extended and placed against the face of the building well above the height at which the scaffolding is desired. A horizontal support bracket (ladder jack) is attached to two or more rungs of each of the ladders.

Planking is then carried up by two men, one on each ladder, and laid on the jacks between the ladders. There are also several problems with this scaffolding method. First, it is difficult to firmly set the feet of the ladders on the uneven, recently excavated, and frequently muddy soil surrounding a building site. Even when a firm footing is secured, an additional difficulty is encountered because the footings must be of the same relative height to the building (or off by a full ladder step spacing) so that the ladder jacks are at the same height in order to make the scaffold planking relatively level. Again, relatively little lateral stability is achieved by extending a single supporting ladder jack from each ladder. The ladders themselves also set a limit to the weight which can be placed upon the scaffolding. Generally, each ladder may only be rated to hold 250 pounds on each step. Thus, for two adjacent ladders, the weight of the ladder jacks, the planking, the construction supplies to be used, and the workmen many not safely exceed 500 pounds. Use of the planking by two fully grown carpenters quickly approaches the safety limits which are, in fact, often exceeded. Finally, the ladders themselves get in the way of workmen walking along the scaffold.

The second alternative scaffolding method is not much better. Instead of ladders providing the vertical support, wooden (or aluminum) columns are used to support pump jacks. Typically, standard two by fours available at the construction site are overlapped and nailed together to form a long column with an approximately square cross section. The length of the column is slightly greater than the ground to roof height of the building. At what will be the top end of the column, metal straps are attached to the column while the bottom end of the column is placed through a pump jack. The pump jack has a mechanism for gripping and advancing the jack up the wooden column and an extension upon which planking may be placed. The wooden column is erected near the face of the building and fastened at its top end with the straps to the roof. Two or more such wooden columns are erected and their bases secured. In use, planks are laid across the horizontal extensions of the jacks on adjacent columns to form a scaffold upon which the "pumpers" can stand. The jacks are then "pumped" up the columns by workmen operating pump levers on the side of each jack. As can be readily appreciated, this scaffolding system suffers most of the same problems of lateral stability and anchor stability as the ladder jack system. It also adds the complexity that during the pumping operation, two or more workmen must carefully coordinate their efforts to maintain the planking relatively level. Given the drawbacks of the ladder jack and pump jack systems, it is no wonder that the time and material intensive system of building attached wooden scaffolding is preferred.

For interiors use, such as when exceptionally high walls or vaulted ceilings are constructed, attached wooden scaffolding is almost always used since the ladder jack system is too difficult to manage in limited interior spaces. As with external use, the lateral stability of the wooden scaffold is a problem although the scaffold may be tied to additional studs to reduce the problem. However, interior wooden scaffolding does limit the amount of additional interior work which can be done until the scaffolding is removed.

The prior patent art of scaffold brackets and support for roofers, painters, and carpenters has a long history. Ramsey, in U.S. Pat. No. 474,406, in 1892, disclosed a window jack for supporting scaffolding along the side of a building under construction. Ramsey's window jack was a triangular brace which was designed to engage the frame of a window from the inside and extend outside where scaffold planking could then be placed on the jack. Once locked onto the window frame, the bracket was stationary. In order to support two ends of the scaffolding, two such window jacks would have to be used locking against adjacent windows or door frames in the structure. Provision was made for adjustment, in a preferred embodiment, to windows of different widths.

In U.S. Pat. No. 945,162, Hause describes a variation of a window jack which was designed to go through a window opening and be secured to the inside window frame, in which the triangular brace for the jack was fastened by links which locked the triangular form into place when the jack was opened or closed. The improvement of this invention was that the links lock the jack open in its open position and lock the jack closed in its closed position so that, when carried, the jack did not unexpectedly open and injure the carrier.

More recently, Shoemaker in U.S. Pat. No. 3,698,680 described a scaffold-support bracket which could be easily attached to a wall form erected to contain poured concrete. Like Ramsey and Hauge, Shoemaker's support bracket consisted of a single triangular bracket with an extension which hooked behind a stationary support. In Shoemaker's case, the stationary support was not a window frame but rather one of the upright posts (strongbacks) erected to take the weight of the poured concrete. Bondi, in U.S. Pat. No. 3,804,199, takes another approach to fastening a triangular support bracket by securing the bracket with a bolt, which passes through the bracket and the vertical support, and is typically used with masonry as in Mausoleum construction. Bondi's bracket may be mounted flush to the face of the masonry as long as access to the other side of the masonry is possible to secure the bolt.

Another approach is illustrated by Sickler in U.S. Pat. No. 4,452,336. Sickler describes a stud gripper which is designed to securely embrace the two sides of a wall stud and provide further support for a two by four. Two stud grippers on studs on one side of a room supporting a two by four between them can be matched with a similar set of grippers on the other side of a room to provide parallel horizontal two by fours upon which scaffold planking can be erected. Nails or bolts may also be used to secure the stud grippers to the studs. A triangular bracket may also be secured to the stud grippers to directly provide support for planking.

Gregory, in U.S. Pat. No. 4,673,060 takes a more direct approach to securing a foldable triangular bracket to an upright by using bolts to attach both the horizontal member and the support member to the stud. Holes are positioned vertically along the stud which is typically a part of a gangform for pouring concrete walls. Scaffold planking is then suspended between two or more attached triangular brackets.

An alternative to supporting the bracket directly from the studs is present by Lapp in U.S. Pat. No. 5,503,358. Lapp hangs a vertical member by a bracket from the top of an erected wall and secures a foldable triangular bracket to the vertical member. For walls of varying thickness, the width of the hanging bracket is adjustable. Essentially, Lapp's triangular bracket attaches to the vertical hanging member much as Gregory's bracket attached to his stud. Recently, Savitski in U.S. Pat. No. 5,535,974 describes a variation of the early triangular brackets which were somehow fixed to the backside, or inside, of a support (such as a window). In Savitski's device, a gripper arm having two grippers which engage the front and back of a stud is rigidly attached to a horizontal member and a support member to form a fixed triangular bracket. When the bracket is positioned so that the grippers engage the front and back of a stud, any downward force on the horizontal arm serves to increase the force exerted by the grippers on the stud. Scaffold planking can then be placed across the horizontal arms of two or more brackets.

In all of the above described prior art devices, the supporting triangular brackets, no matter how mounted, were individual units which had to be used in combination with at least one other of the same kind to provide separated positions from which to suspend scaffolding. Further, the lateral stability of each bracket depended on the stability of the member to which it was mounted, typically a stud of some type. If the stud twisted, the brackets would rotate. Conversely, the extended support arms of the triangular brackets provide a long moment arm with which to twist the vertical supports (studs) if caution is not exercised and a torque is inadvertently applied. Finally, in building construction, access to the rear side of a stud as is required for many of the bracket mounting schemes is not possible once exterior sheathing has been applied. These, and other problems with the prior art devices are eliminated or solved with the brace of this invention.

SUMMARY OF THE INVENTION

The present invention consists of a self supporting brace which may be quickly secured by one man to two adjacent upright studs of a framed building. The brace may be mounted flush on any smooth surface and does not require support from the ground. The brace of the invention consists of a generally "U" shaped bracket with a platform extending out perpendicularly from near the upper ends of each vertical arm of the "U". The two vertical arms of the "U" shaped bracket are fastened to two adjacent studs, one arm to each stud. The outer end of the platform is supported by a lower arm which is anchored at the bottom middle of the "U" shaped bracket located between the studs. Two or more of these braces may be used in conjunction to provide supports for scaffolding planking. The brace is made of channel iron which is strong and light enough to be easily carried up a ladder and attached to the framing by one man. When not in use, the unit may be folded and laid flat for storage. Since the brace attaches to the faces of two studs and is itself rigid, no torque is applied which can twist the studs.

It is an object of this invention to provide a scaffolding support brace which may be used with framing construction and does not require the building of extensive wooden support scaffolding or the use of ladder or pump jacks.

It is a further object of this invention to provide a support for scaffolding which may be directly attached to the side of a building under construction, either directly to the studs or to studs covered by sheathing, and does not require any support from the ground.

It is another object of this invention to provide a scaffolding support brace which may be carried and mounted easily and quickly by one man.

It is yet another object of this invention to provide a scaffolding support brace which may be easily removed from when its use is no longer needed.

It is a further object of this invention to provide a scaffolding support brace which will support loads well in excess of the loads which may be supported by typically erected wooden scaffolding or ladder or pump jack systems.

It is another object of this invention to provide a scaffolding support brace which provides a platform upon which a man may stand.

It is yet another object of the invention to provide a support brace which may be quickly set up to provide a temporary work or storage surface.

Additional features of the invention will become apparent from the detailed description which follows.

BRIEF DESCRIPTION OF THE DRAWINGS

FIG. 2 is a view of the scaffolding brace as seen straight on.

FIG. 3 is a cross sectional view of an angle iron showing the two arms and supporting surface.

FIG. 4 is a view of the scaffolding brace as seen from the side.

DETAILED DESCRIPTION OF THE PREFERRED EMBODIMENT

Figure 1:
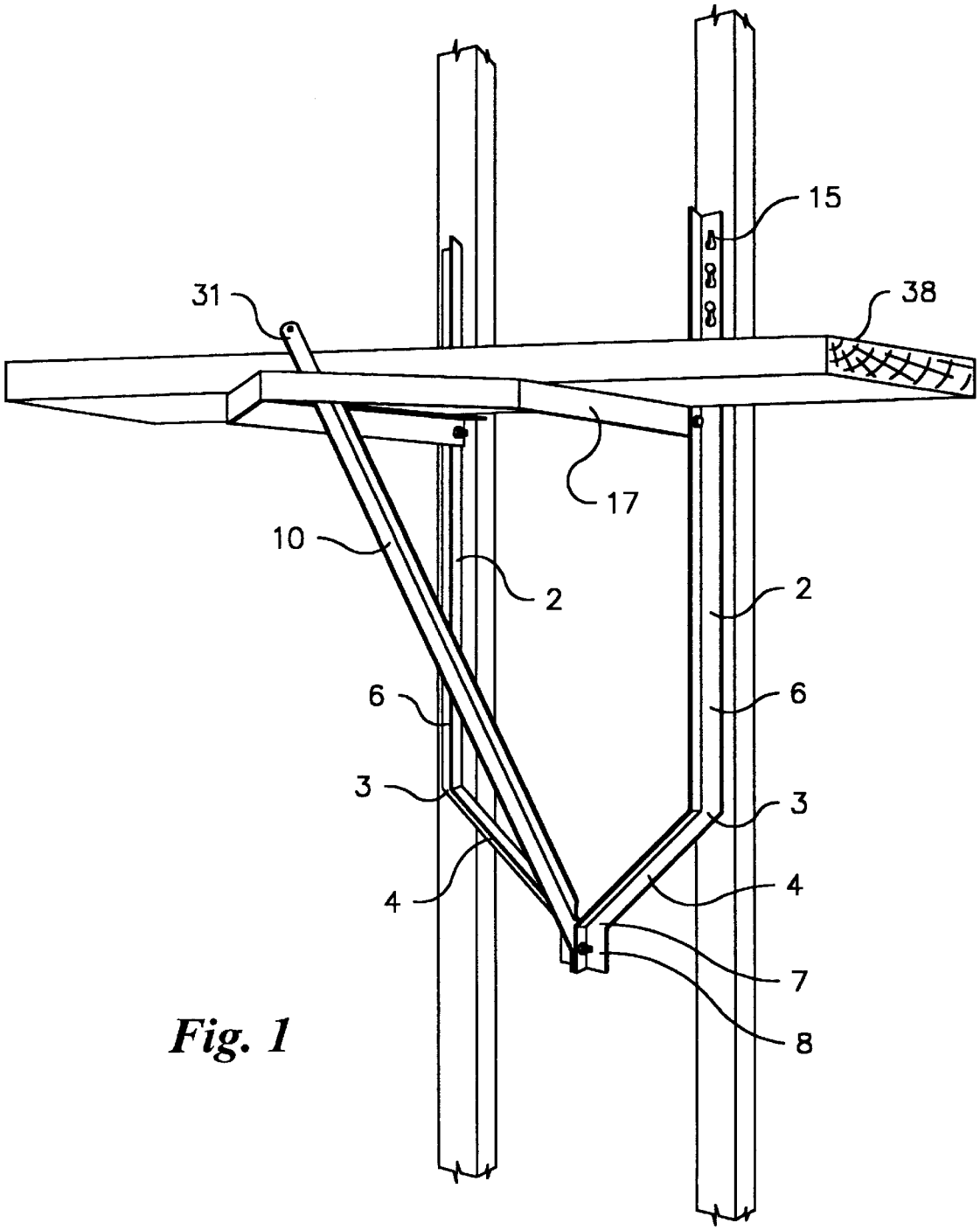
FIG. 1 is an oblique view from below showing the scaffolding brace attached to two adjacent studs with the platform locked into its horizontal position.
Figure 2:
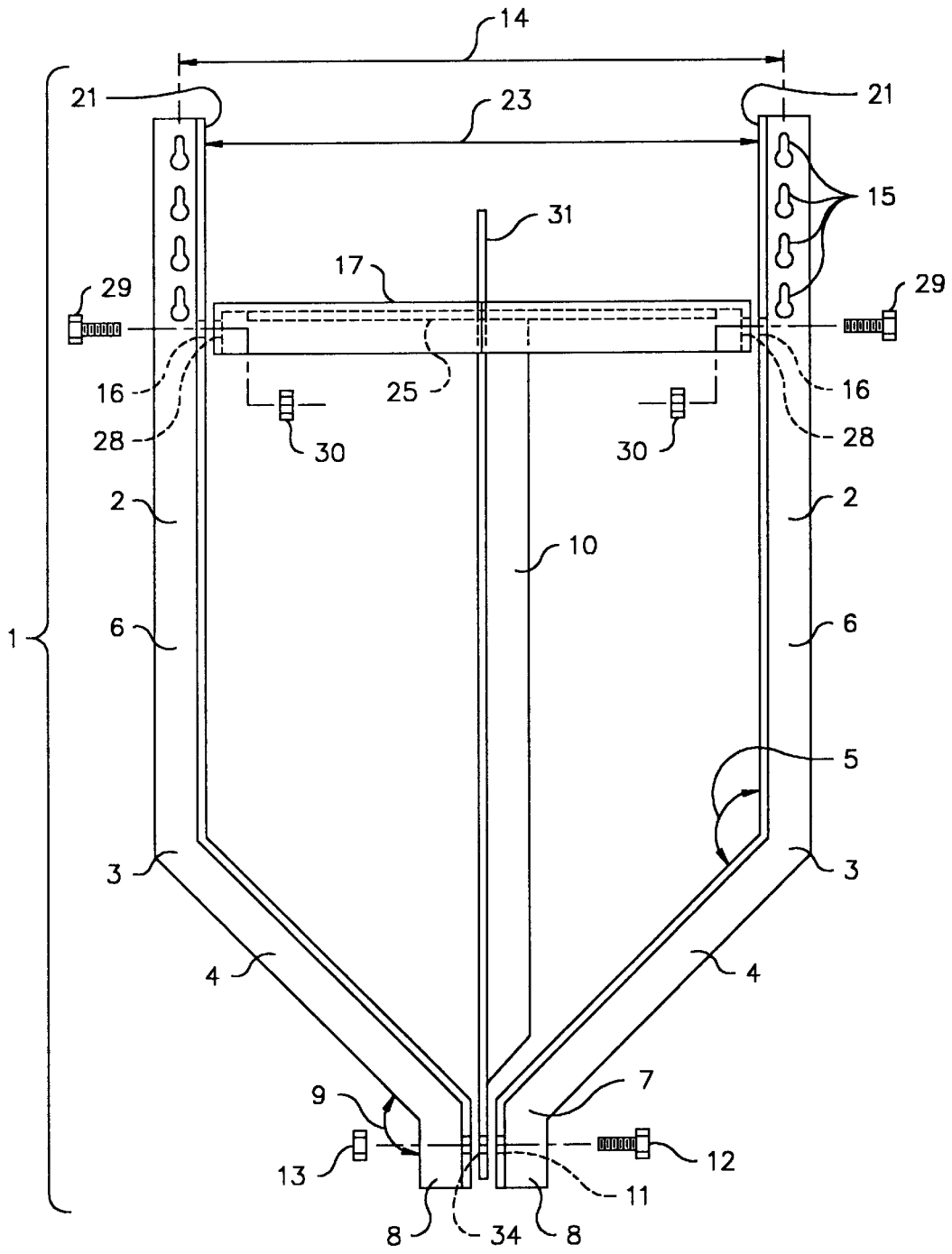

The scaffolding brace of the present invention is designed to be supported by two adjacent upright studs or any other sufficiently strong mounting surface. In standard construction, adjacent studs are erected on 16 inch centers and the scaffolding brace of this invention is typically dimensioned for use on 16 inch centers. However, as will be clear from the following description, the design of the scaffolding brace is not dependent on the inter-stud spacing and the dimensions of the brace may be varied to accommodate stud spacings of different dimensions. FIGS. 1 and 2 show the main features of scaffolding brace 1. Brace 1 is formed from two attachment arms 2 each of which is a mirror image of the other. In the preferred embodiment, the attachment arms are made from steel angle iron. Angle iron typically has a cross section as shown in FIG. 3 in which two arms are formed at substantially right angles to each other. Angle iron is extremely strong and resists bending in any direction. As can be seen in FIG. 1, placing one face (arm) of the angle iron flush against the front surface of a stud consequently projects the other arm of the angle iron outwards from the stud at a right angle. For purposes of this description, the arm of the angle iron which is placed against a stud or other flat surface is designated S and the arm of the angle iron which is perpendicular to the stud or other flat mounting surface is designated P.

Each attachment arm 2 has an inward bend 3 so that a shorter bearing section 4 extends at an angle 5 to the longer section 6 of each attachment arm 2. Bearing section 4 has an outward bend 7 near its end so that a fastening section 8 extends at an angle 9 to bearing section 4. Angles 5 and 9 should be the same so that fastening sections 8 are parallel to the long section 6 of each attachment arm 2. In the preferred embodiment, angles 5 and 9 are 45 degrees. The two bends 3 in each attachment arm bring the two fastening sections 8 together substantially midway between the longer section 6 of each arm. A locking arm 10 is located between the two fastening sections 8. Fastening section 8 has a hole 11 passing through the outward directed arm P of the angle iron. Locking arm 10 has a similarly sized hole 34 near the end which fits between fastening sections 8 and which is aligned with the holes in fastening sections 8. A bolt 12 passes through the holes 11 and 34 and is captured by nut 13. The bolt may be oriented either as shown FIG. 1 or FIG. 2. In this manner, locking arm 10 is pivotally connected to fastening sections 8 and attachment arms 2 are connected.

Those skilled in the metal working arts are familiar with methods to introduce such bends 3 and 7 in angle iron. One method which may be used is to cut a "V" shaped section out of one arm of the angle iron at the point where the bend is desired. This permits the other arm of the angle iron to be bent to the correct angle. After the bend is made, the "V" shaped cutout may be rewelded in place along with additional welding material to completely fill the cutout area. In this manner, the angle iron may be bent and its strength restored.

The length of bearing sections 4 depend upon the spacing of the studs to which the brace 1 is to be mounted. Dimensionally, it is important that the length of bearing sections 4, when bolted together as described above on either side of locking support 10, is such that the spacing 14 between the center lines of each mirror image attachment arm 2 corresponds to the inter-stud centerline distance. For 16 inch stud spacing and 1¼ by 1¼ by 3/16 angle iron, the length of each bearing section 4 should be approximately 10¼ inches. Clearly, slight differences in methods of manufacture, the angle of the bends, and dimensions of materials used will alter the exact length needed for the bearing sections 4.

Near the end of attachment arm 2 opposite the end of bearing section 4, several attachment holes 15 are located substantially on the centerline of the S arm of the angle iron which faces the surface of the studs. In the preferred embodiment, holes 15 are keyhole shaped to aid in the easy mounting and removal of the brace. For attaching platform 17 to attachment arms 2, attachment holes 16 are located along the length of attachment arm 2 in the P arm of the angle iron which projects perpendicularly outwards from the stud. The placement of holes 16 along attachment arms 2 may be varied to accommodate longer or shorter platform 17 lengths. In the preferred embodiment, locking support 10 forms an isosceles right triangle with attachment arms 2 and platform 17. If holes 16 are placed closer to the lower end of support brace 1 nearer fastening sections 8, platform 17 needs to be correspondingly shorter. If holes 16 are located near the top end of attachment arms 2, platform 17 needs to be correspondingly longer. In the preferred embodiment, holes 16 are located near the top end of attachment arms 2 just below the position of the nail mounting holes 15.

Figure 5:
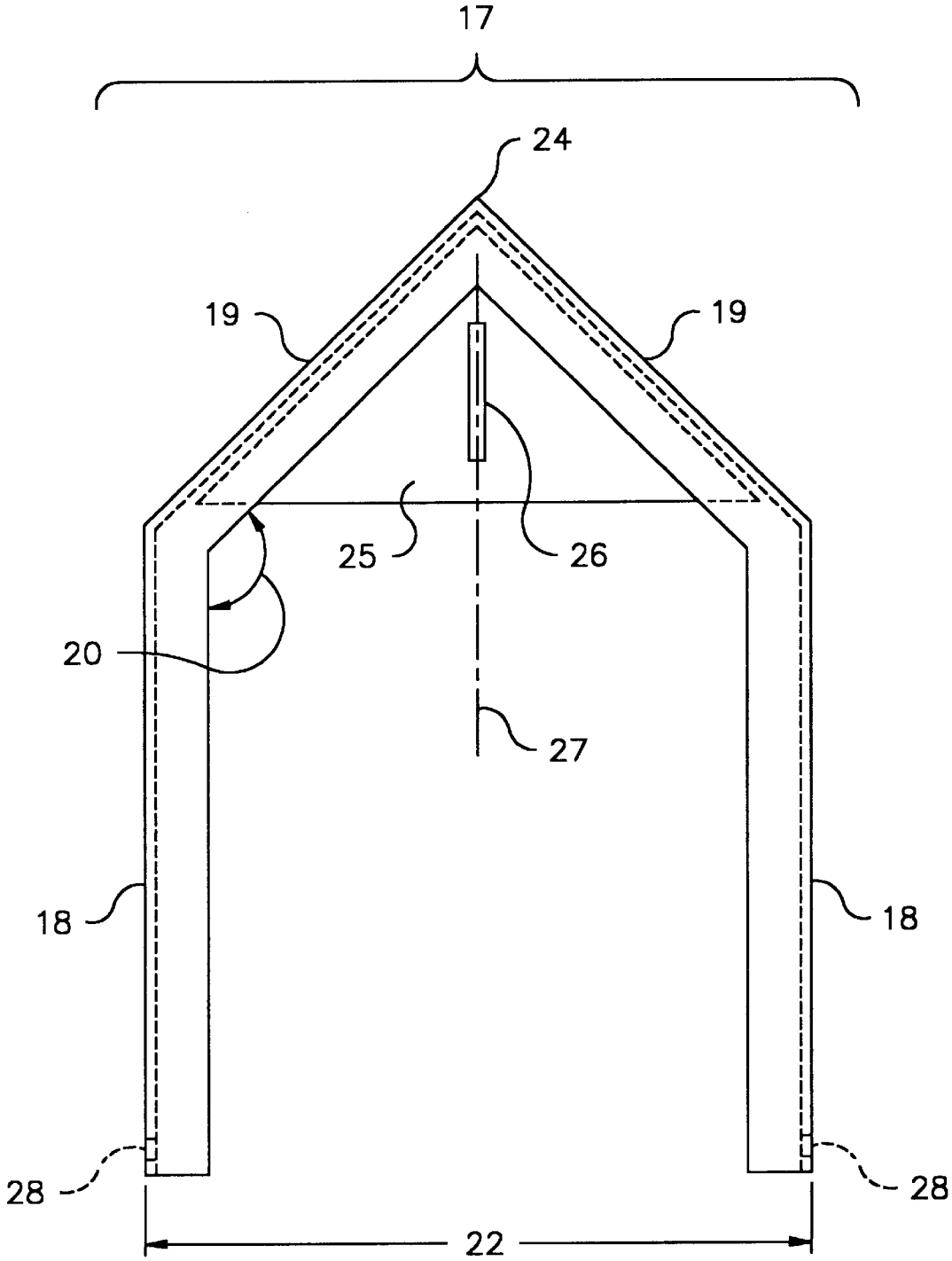
FIG. 5 is a view of the scaffolding brace platform as seen from above.

As shown in FIG. 1 and FIG. 4, scaffolding brace 1 has a support platform 17 which extends outwardly from attachment arms 2 and the studs. As shown in FIG. 5, platform 17 is also formed from angle iron and consists of two mirror image support arms 18 each of which has a section 19 bent at an angle 20. In the preferred embodiment, angle 20 is 45 degrees. The same size angle iron may be used for support arms 18 as was used for attachment arms 2. In the preferred embodiment of platform 17, the angle iron is oriented so that a flat face of one angle iron arm of support arm 18 forms the top surface of platform 17 while the outside flat face of the other angle iron arm of support arm 18 faces the interior surface 21 of each attachment arm 2.

As with bearing sections 4, dimensionally the combined length of sections 19 is such that, when platform 17 is assembled, the spacing 22 between the outside angle arm of each mirror image support arm 18 is substantially the same as the distance 23 between attachment arms 2. In the preferred embodiment, for use with 16 inch spaced studs and 1¼ by 1¼ by 3/16 angle iron, the length of each section 19 is approximately 10 inches.

Support platform 17 is formed by fastening the two support arms 18 together at 24. Typically, the fastening may be made with a weld. In the preferred embodiment platform 17 has a triangularly shaped locking plate 25 rigidly fastened to the undersides of the top angle iron arm of each section 19. In the preferred embodiment locking plate 25 is welded to the angle iron of sections 19. Locking plate 25 has an elongated slot 26 oriented along the centerline 27 of support platform 17. The length and width of slot 26 is sufficient to permit the locking tab 31 (described below) on locking support 10 to pass through and be restrained from lateral movement.

Figure 6:
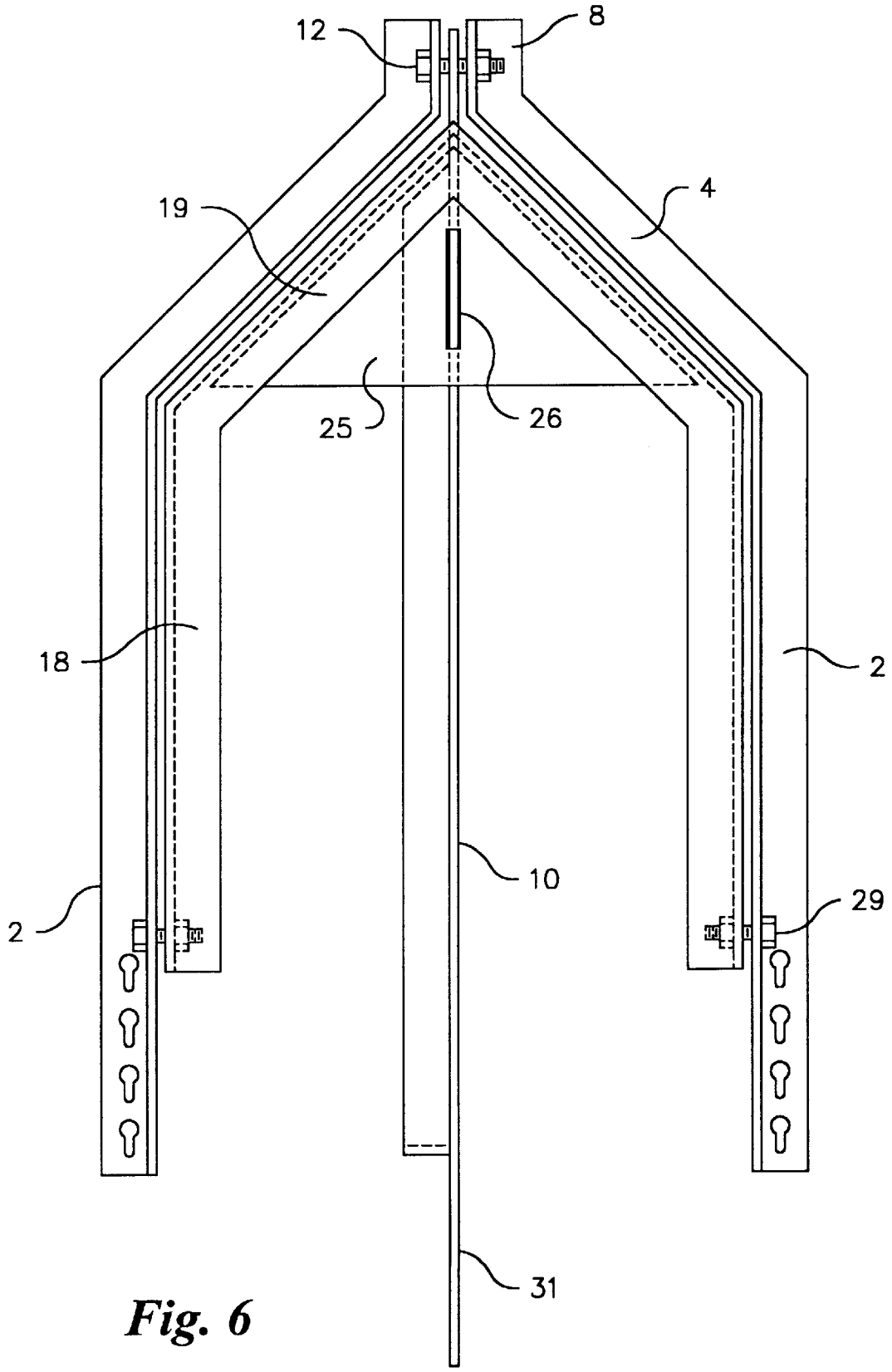
FIG. 6 shows the scaffolding brace in a collapsed or folded arrangement.

Near the end of each support arm 18 a hole 28 passes through the angle iron arm which is perpendicular to the top surface of platform 17. Platform 17 is rotatably secured to attachment arms 2 by means of bolts 29 which pass through the holes 16 and 28 and which are secured with nuts 30. Appropriate washers (not shown) may also be used with bolts 29 and nuts 30. In the preferred embodiment, dimensionally, the length of support platform arms 18 is such that support platform 17 may be rotated about bolts 29 so that it is substantially coplanar with attachment arms 2 and fits within the space defined by attachment arms 2 as shown in FIG. 6.

Figure 7:
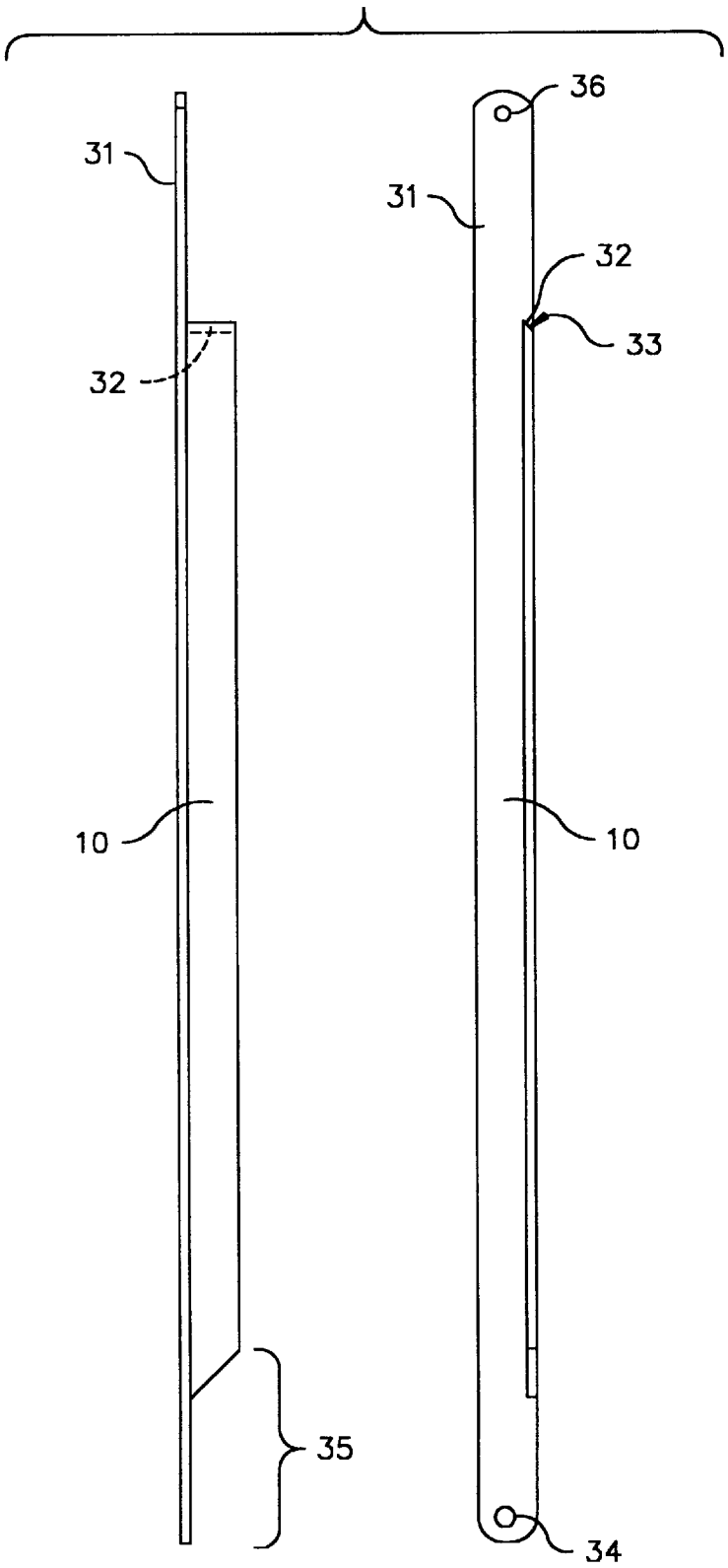
FIG. 7 shows a top and a side view of the locking support.

FIG. 7 shows locking support 10. Locking support 10 is formed from a single piece of angle iron of approximately the same dimensions as the angle iron used to form attachment arms 2 and platform support arms 18. At one end of locking support 10 a portion of one of the two angle iron arms is removed in order to leave the other angle iron arm extending as a locking tab 31. The leading edge 32 of the cut away angle arm is cut at an angle 33 to the forward edge of locking tab 31 which will permit the bottom side of locking plate 25 to rest flat on edge 32. In the preferred embodiment, angle 33 is 45 degrees. The length of locking tab 31 is sufficient to extend through and beyond slot 26 in locking plate 25. At the other end of locking support 10 in the same arm of the angle iron which forms locking tab 31 is located hole 34. In order to permit locking support 10 to be pivotally attached to fastening sections 8, the same angle iron arm as was cut away to form locking tab 31 is also cut away to provide a clearance 35 so that when locking support 10 is fastened to fastening sections 8 with bolt 12 and nut 13 as described above, locking support 10 may be freely rotated. Dimensionally, locking support 10 is sufficiently long so that when locking tab 31 is placed through slot 26 in locking plate 25 and locking plate 25 rests on angle iron arm edge 32, platform 17 is substantially perpendicular to attachment arms 2 and the supporting surface or studs. In the preferred embodiment, the angles between locking support 10 and platform 17 and locking support 10 and attachment arms 2 are 45°. To collapse brace 1 for carrying, locking support 10 may be rotated into a folded and substantially coplanar orientation with attachment arms 2 as shown in FIG. 6.

Figure 8:
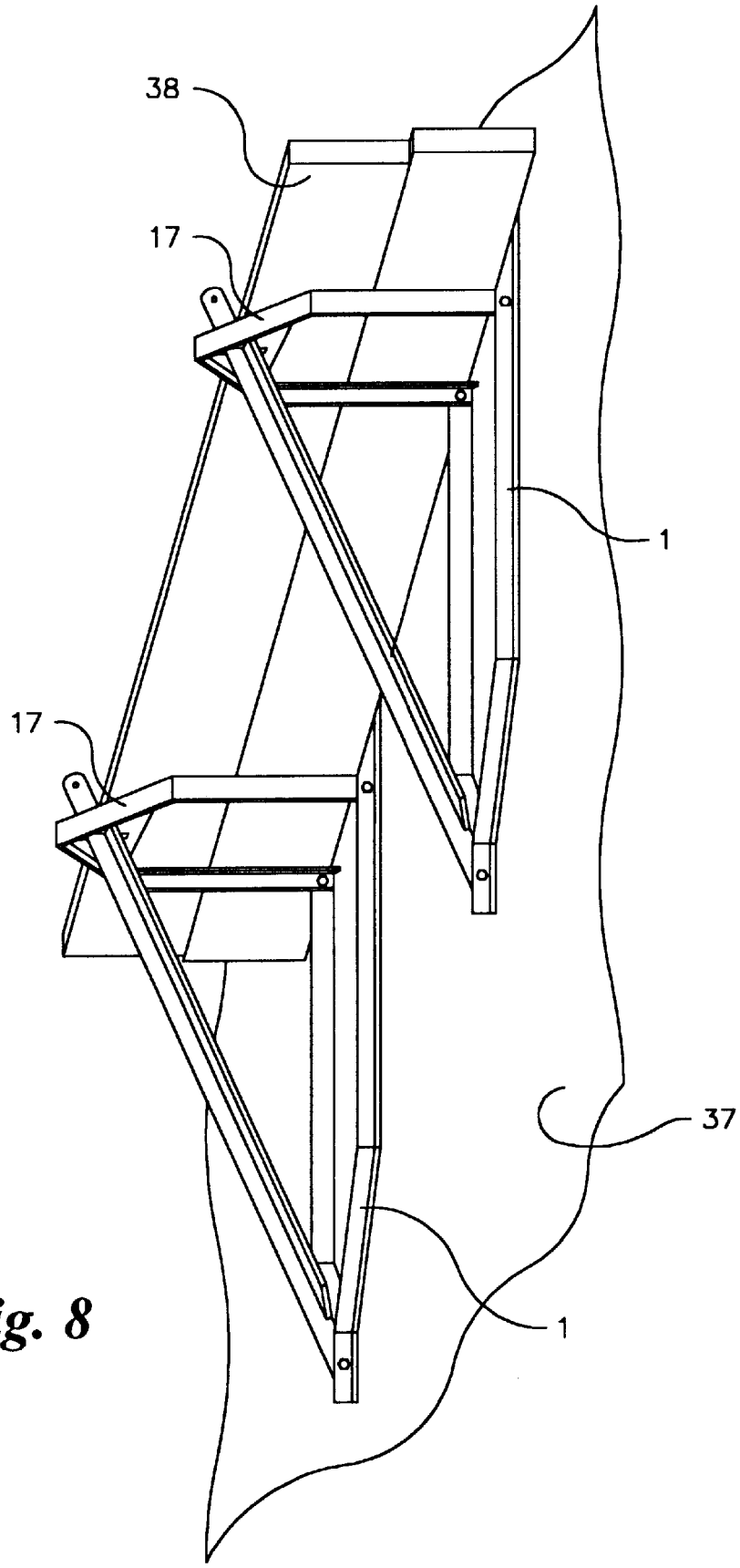
FIG. 8 shows two braces mounted on the side of a building under construction.

FIG. 8 shows two of the scaffolding braces 1 of this invention attached flush to the outside of a building under construction. The studs have already been covered with sheathing 37, but the scaffolding braces 1 are mounted so that the mounting nails pass through the sheathing into the studs. It can be seen that the scaffolding braces are self supporting and require no further support from the ground. Planking 38 has been placed across the two platforms 17 of the scaffolding braces. As is shown in FIG. 1, locking tab 31, which passes through slot 26 in locking plate 25, extends above the top surface of support platform 17 and acts to prevent planking 38 from easily sliding off the end of platform 17. Several scaffolding braces may be mounted along the face of a building to provide a continuous scaffolding platform along the building.

Two additional safety related features may be incorporated into scaffolding brace 1. First, a hole 36 may be located in locking tab 31 of locking support 10. A safety locking pin (not shown) may be placed through hole 36 after locking tab 31 is placed through slot 26 to prevent platform 17 from being accidentally displaced off of locking support 10 by an upwards force. Second, where required by local regulations, vertical handrail supports (not shown) may be attached by bolting to arms 18 and 19 of platform 17 which supports would extend above the top surface of platform 17. Safety handrails (not shown) could then be attached to these handrail supports.

While the preferred embodiment of the invention has thus been described, modifications as would be obvious to those skilled in the art may be made and are considered within the scope of this disclosure. For instance, by way of an example and not meant to be limiting, the angle iron forming attachment arms 2 could be rotated 90° so that the angle iron arms P to which platform 17 mounts were located at the outer sides of attachment arms 2 rather than at the inner sides 21 as described above. Dimensions would have to be adjusted accordingly and the angle iron forming the platform rotated 90° so that an arm of the angle iron of support 18 faced inward. Those skilled in the metal working arts will also appreciate that square solid bars or square hollow rods could be used to form the supporting brace. Indeed, even round solid or hollow rods could also be used as long as right angles were maintained for the pivoting attachment points. Nor is the scaffolding brace limited to use on the exterior of buildings. When high or vaulted interior ceilings are required, the scaffolding brace may easily be suspended between two adjacent internal studs.

In practice, the scaffolding brace of this invention is exceedingly simple to use at a construction site. The brace is very strong, relatively light in weight, and is easily carried by one person. For instance, a scaffolding brace of this invention formed from 1¼" by 1¼" by 3/16" angle iron weighs less than 30 pounds and has outside dimensions (including the locking support) of approximately 44 11/16"× 17¼". A platform length of approximately 29¾" and a locking support length of approximately 44" provides 24" of usable platform space for planking. On a building which has had external sheathing attached, a single nail may be placed through the sheathing into a supporting stud where it is desired to locate the scaffolding brace. One man can carry the brace up a ladder or lean out of a window opening to place the keyhole slot of one attachment arm over the nail to initially hang the brace. The brace can easily be rotated about the first nail to a vertical position and a second nail can then be driven through one of the nail holes in the opposite attachment arm to secure the brace. Additional nails as thought necessary for safety can then be used. Once the brace is secured, the platform is simply raised and locked into position by placing the tab on the locking support through the slot in the platform locking plate.

It should be noted that the design of the scaffolding brace of this invention yields a brace which can safely support loads far in excess of those supported by any of the alternate scaffolding systems discussed earlier. This is in large measure due to the fact that the triangular bracing achieved by the locking support distributes a major portion of the load horizontally against the studs or supporting surface and not vertically on the hanging nails. When the brace is mounted on a flat surface such as exterior sheathing, the load is further distributed by the sheathing over several studs. For the same reason, the brace may be used over insulation sheath which has been applied to the exterior sheathing without significantly damaging or crushing the insulation. Even in the case of the brace being mounted to two bare studs so that bearing sections 4 do not directly rest against any surface, such as in an inside vaulted ceiling application, the strength of the angle iron in bearing sections 4 is sufficient to carry the load from locking support 10 to the longer sections 6 of attachment arms 2 mounted on the studs.

In addition, a 16 penny galvanized nail has a shear strength of about 500 pounds. As many nails can be placed through each attachment arm 2 as is felt required to be safe. In actual tests using the preferred embodiment and sized as indicated above, a single scaffolding brace of this invention was able to support in excess of 1600 pounds using just four nails through each attachment arm 2 when mounted on an externally sheathed building. In a scaffolding application, at least two braces are used with scaffold planking suspended between the braces. On the average, each brace needs to support only half of the weight of the planking and anything placed on the planking. Clearly, the scaffolding brace of this invention has an inherently greater safe loading limit than any of the three alternative scaffolding systems discussed above.

In addition, the scaffolding brace of this invention can not move or twist side to side like the support extensions of ladder jacks and pump jacks since the brace is mounted at two separate points (attachment arms) which are securely connected to each other and the support platform. Thus, an exceptionally sturdy scaffold is formed when planks are suspended between two or more of the braces. It should also be noted that for work in a limited area, a single brace may be used with a board of the same size as the brace platform securely mounted to the platform. The braces of this invention may also be used to erect temporary shelving or work benches. Often at construction sites it is necessary to store building materials. The braces of this invention may be mounted on any convenient framing or surface and used to store materials either with or without the necessity of placing planking across the braces. Temporary work benches can also be quickly constructed by placing the braces and cross planking at the proper working height. Semi-permanent work benches can be formed by mounting the braces in a collapsed or folded position on a wall such as in a garage. When needed, the platform and locking support can be quickly erected and work surface boards placed across the braces.

Unlike the systems of the prior art described earlier, disassembly and removal of the scaffolding braces of this invention is simple and quick. After all loads have been removed from a brace, a slight outwards pull at the bottom fastening section 8 acts to loosen the nails at the top since the attachment arms 2 act as levers to pull the nails loose. If all the nail holes are slotted, the brace may then be easily lifted off the nails. Otherwise, the nails may be removed with a hammer. Unlike the systems of the prior art which require extensive disassembly, the brace of this invention comes cleanly and quickly off of its mounting surface. As shown in FIG. 8, the scaffolding brace is easily folded substantially flat for easy carrying and storage.

While this invention has been described with reference to a preferred embodiment, modifications and adaptations of the basic invention are to be considered within the scope of this disclosure and the accompanying claims.

What is claimed is:

1. A scaffolding brace which may be secured flush to a surface of a support comprising:

a pair of rigid attachment arms each having an elongated, surface-engaging section having upper and lower ends, and a bearing section extending from the lower end of its surface-engaging section, the surface-engaging sections having substantially coplanar surface-engaging faces and extending in parallel lines, the surface-engaging sections being in opposed relationship to each other and being spaced from each other so that an open space is provided between them, and the bearing sections extending toward, and being attached to, each other at an intermediate location between said parallel lines;

a locking arm pivotally connected to the bearing sections at said intermediate location;

a platform pivotally connected to the surface engaging sections of the two attachment arms, the platform being movable from a collapsed position in which it is substantially coplanar with the attachment arms to an extended position in which it projects outward in transverse relation to the attachment arms; and means for releasably engaging the locking arm with the platform to support the platform in said extended position.

2. The scaffolding brace of claim 1, in which each of said elongated, surface-engaging sections has a plurality of holes through which fasteners may be placed for securing the attachment arms to a surface of a support, at least one of the holes on one of said elongated, surface-engaging sections being keyhole-shaped whereby it can be engaged with a nail previously driven into a surface of a support to which the scaffolding brace is to be secured.

3. The scaffolding brace of claim 1, in which the means for engaging the locking arm with the platform comprises:

a tab and a plate-engaging edge at one end of the locking arm; and a platform locking plate rigidly secured to the platform, the locking plate being engageable by said plate-engaging edge and having a hole positioned to receive said tab and preventing disengagement of the platform and the locking arm from each other while the platform is in its extended position.

4. The scaffolding brace of claim 1, in which the two attachment arms are mirror images of each other.

5. The scaffolding brace of claim 1, in which the platform comprises two platform arms, and in which the attachment arms, the locking arm, and the two platform arms are formed from angle iron.

6. The scaffolding brace of claim 1, including means on the surface-engaging sections of the attachment arms for fastening the surface-engaging sections to a support.

7. The scaffolding brace of claim 1, in which each of said elongated, surface-engaging sections has means thereon for connection to a support, and in which the spacing of the elongated, surface-engaging sections is such that the connection means on each of the surface-engaging sections is approximately sixteen inches from the connection means on the other of the surface-engaging sections.

8. The scaffolding brace of claim 1, in which each of said elongated, surface-engaging sections has a line of holes through which fasteners may be placed for securing the attachment arms to a surface of a support.

9. The scaffolding brace of claim 1, in which each of said elongated, surface-engaging sections has a line of holes through which fasteners may be placed for securing the attachment arms to a surface of a support, and in which the spacing of the elongated, surface-engaging sections is such that the line of holes of each of the surface-engaging sections is approximately sixteen inches from the line of holes of the other of the surface-engaging sections.

10. The scaffolding brace of claim 1, in combination with a support comprising a plurality of upright studs, arranged in spaced relationship to one another, with the centerlines of adjacent studs being a predetermined distance from each other, in which each of the surface-engaging sections of the attachment arms has a line of holes for receiving fasteners to secure said surface-engaging sections to the studs, the line of holes of each surface-engaging section being spaced from the line of holes of the other surface-engaging section by a distance substantially equal to said predetermined distance.

11. The scaffolding brace of claim 1, in which the platform is of a size such that it fits between the attachment arms when in said collapsed condition.

12. The scaffolding brace of claim 1, in which said bearing sections extend obliquely downward toward each other from the lower ends of the surface-engaging sections, whereby which the intermediate location to which the locking arm is pivotally connected is below the lower ends of the surface engaging sections.

* * * * *